US012584654B2

(12) United States Patent
Bryant

(10) Patent No.: US 12,584,654 B2
(45) Date of Patent: Mar. 24, 2026

(54) PORTABLE COOLING AND HEATING CONTAINER

(71) Applicant: Billy Bryant, Vicksburg, MS (US)

(72) Inventor: Billy Bryant, Vicksburg, MS (US)

( * ) Notice: Subject to any disclaimer, the term of this patent is extended or adjusted under 35 U.S.C. 154(b) by 1025 days.

(21) Appl. No.: 17/482,604

(22) Filed: Sep. 23, 2021

(65) Prior Publication Data

US 2022/0341626 A1 Oct. 27, 2022

Related U.S. Application Data

(60) Provisional application No. 63/178,243, filed on Apr. 22, 2021.

(51) Int. Cl.

| | |
|---|---|
| ***F24H 1/06*** | (2022.01) |
| ***B65D 81/38*** | (2006.01) |
| ***F24H 1/18*** | (2022.01) |
| ***F24H 9/20*** | (2022.01) |

(52) U.S. Cl.

CPC ..... *F24H 1/06* (2013.01); *B65D 81/3802* (2013.01); *F24H 1/185* (2013.01); *F24H 9/2021* (2013.01); *F24H 2250/02* (2013.01)

(58) Field of Classification Search

CPC ..... B67D 2210/00128; A47J 41/005; F24H 1/06; F24H 1/185; F24H 9/2021; F24H 2250/02; B65D 81/3802; B65D 81/3846; B65D 81/3811

USPC ..... 219/383–386, 438–448.19, 458.1–467.1, 219/520–522, 531, 533, 538–553, 219/628–641; 220/592.16–592.28

See application file for complete search history.

(56) References Cited

U.S. PATENT DOCUMENTS

| | | | | | |
|---|---|---|---|---|---|
| 1,240,449 | A | * | 9/1917 | Hinshaw et al. | H05B 3/00 219/201 |
| 2,376,537 | A | * | 5/1945 | Hall | F24H 1/202 392/452 |
| 2,784,291 | A | * | 3/1957 | Harney | F24H 9/0021 392/452 |
| 5,052,187 | A | * | 10/1991 | Robinson, Jr. | F24H 4/04 62/238.7 |
| 5,406,976 | A | * | 4/1995 | Bekki | F16K 15/144 137/513.3 |
| 5,705,209 | A | * | 1/1998 | Wright | B65D 85/73 426/118 |

(Continued)

FOREIGN PATENT DOCUMENTS

| | | | | | |
|---|---|---|---|---|---|
| CN | 111658299 | A | * | 9/2020 | |
| KR | 20110093417 | A | * | 8/2011 | F24H 1/201 |

*Primary Examiner* — Eric S Stapleton

(74) *Attorney, Agent, or Firm* — Brennan, Manna & Diamond, LLC

(57) ABSTRACT

A portable heating and cooling container for keeping retained liquids heated or cooled in the same compartment. An insulated vessel with a foam or vacuum insulating layer keeps the retained liquids at a consistent temperature for long periods of time. A heating component is attachable to an outside of an insulated vessel. The heating element is not used when the retained liquids are desired to be cool or cold. The heating component may penetrate either a double side-wall of the vessel housing or the vessel lid. A resistance heating element is retained within the insulated vessel to heat the retained liquid on demand as desired allowing for access to heated liquids remotely.

17 Claims, 7 Drawing Sheets

(56) References Cited

U.S. PATENT DOCUMENTS 6,276,559 B1 * 8/2001 DeMars ..... A47G 19/2266 215/229
6,282,372 B1 * 8/2001 Boros ..... F24H 15/223 392/501
7,166,822 B1 * 1/2007 Chang ..... A47J 36/34 219/521
7,182,222 B2 * 2/2007 Prabucki ..... B67D 3/0029 222/608
7,718,928 B2 * 5/2010 He ..... A47J 27/09 219/431
9,140,476 B2 * 9/2015 Eckhoff ..... B65D 81/3811
9,717,114 B1 * 7/2017 Walker ..... F25B 21/04
2003/0070430 A1 * 4/2003 Beckius ..... A47J 27/21 60/645
2003/0113107 A1 * 6/2003 Winter ..... F24H 1/06 392/447
2003/0198465 A1 * 10/2003 Cai ..... A47J 31/542 99/275
2005/0120887 A1 * 6/2005 Ejaz ..... A47J 27/10 99/331
2006/0124665 A1 * 6/2006 Prabucki ..... B67D 3/0029 222/129.1
2008/0105843 A1 * 5/2008 Koenekamp ..... F16K 49/002 251/231
2010/0230424 A1 * 9/2010 Bartlett ..... B65D 81/3846 220/592.26
2010/0254834 A1 * 10/2010 Tolbert, Jr. ..... F04B 53/08 219/209
2011/0132893 A1 * 6/2011 Lin ..... A45F 3/18 220/592.27
2011/0132922 A1 * 6/2011 Summers ..... A47G 19/2266 222/207
2013/0042938 A1 * 2/2013 Ferrone ..... F16L 11/127 138/33
2013/0306656 A1 * 11/2013 Eckhoff ..... F25D 3/125 62/304
2014/0105584 A1 * 4/2014 Flohr ..... F24H 15/225 392/441
2016/0084526 A1 * 3/2016 Farris ..... F24H 15/144 392/463
2016/0175866 A1 * 6/2016 Kalalau ..... A45F 3/16 222/394
2018/0238561 A1 * 8/2018 Yin ..... F24H 15/335
2019/0174945 A1 * 6/2019 Oti ..... A47J 27/004
2019/0212019 A1 * 7/2019 Liu ..... F24F 5/0096
2020/0217051 A1 * 7/2020 Murray ..... B29C 41/04
2020/0224789 A1 * 7/2020 Feuster ..... A62C 35/68
2021/0095891 A1 * 4/2021 Hazzard ..... F24H 9/45
2025/0116354 A1 * 4/2025 Swirniak ..... E03F 1/006

* cited by examiner

PORTABLE COOLING AND HEATING CONTAINER

CROSS-REFERENCE TO RELATED APPLICATION

The present application claims priority to, and the benefit of, U.S. Provisional Application No. 63/178,243, which was filed on Apr. 22, 2021 and is incorporated herein by reference in its entirety.

FIELD OF THE INVENTION

The present invention generally relates to a container for cooling and heating a liquid, and more specifically to an insulated portable container configured to keep liquids cool or to heat liquids and keep them warm. Accordingly, the present specification makes specific reference thereto. However, it is to be appreciated that aspects of the present invention are also equally amenable to other like applications, devices, and methods of manufacture.

BACKGROUND

There are many situations where a jug or container of hot or cold water is needed, whether for bathing, mixing, warming, etc. Water or other liquids are typically kept cool in a traditional insulated five gallon cooler without much trouble. However, heating water up and keeping it warm for an extended period of time in a water jug is difficult. In a cold weather situation, hot water is not always readily available to warm someone. Without a heated water source, such as when camping, there is no warm water available for washing or cleaning. On construction sites, warm water is often needed for mixing materials and there is no way to conveniently create the mixture without the warm water.

Insulated water containers or jugs are well known and useful for providing a relatively large quantity of water from a single container. Traditional one, two and a half, five, or ten gallon water jugs are commonly used for sporting events or training, outdoor work sites, camping, picnics, or outdoor community gatherings. These water jugs are insulated and configured to keep the contained water cool. Cold water, water and ice, or other cooled liquids are added and remain cool for several hours in the unopened container.

These insulated water containers or jugs will also keep the contained liquids warm for a while if a warm liquid was initially added. The insulated containers essentially act like a thermos or similar insulated hot liquid vessel. However, the heated liquid eventually will cool much quicker than cold water would warm up due to the inefficiency of the vessel. Simply put, it is easier to maintain a colder temperature than a warmer one from convection, conduction, or radiation. Some insulated coolers are rated to keep ice intact for up to several days as opposed to typically a few hours for heated liquid contents.

Additionally, once a cooler with cold water warms up, it is relatively easy to decrease the temperature of the liquid by adding ice. Conversely, heating up the contents requires a convenient hot water source which is not as readily available as ice. Existing insulated water containers or jugs have no convenient way or mechanism to reheat the contents on demand or to keep the temperature consistent.

Accordingly, there is a great need for a dual use insulated container for retaining liquids. There is also a need for a container that allows users to heat, store, and dispense hot or warm water from the jug or container. Similarly, there is a need for container to keep liquids cold, while also providing the added benefit of a hot water option. There is also a need for a container configured to dispense hot water in cold weather situations, as well as in power outages or remote locations due to the cooler's ability to keep the water heated for long periods of time. Further, there is a need for a portable hot or cold water source in situations where water is not readily available or accessible.

In this manner, the improved heating and cooling container of the present invention accomplishes all of the forgoing objectives, thereby providing an easy solution for keeping liquids heated or cooled in a single container. A primary feature of the present invention is a container for heating, storing, and dispensing hot or warm water, or for storing and dispensing cooled liquids. The present invention provides a portable on-demand hot water source. Finally, the improved of the present invention is capable of providing a hot or cold water source where water is not otherwise readily available.

SUMMARY

The following presents a simplified summary in order to provide a basic understanding of some aspects of the disclosed innovation. This summary is not an extensive overview, and it is not intended to identify key/critical elements or to delineate the scope thereof. Its sole purpose is to present some concepts in a simplified form as a prelude to the more detailed description that is presented later.

The subject matter disclosed and claimed herein, in one embodiment thereof, comprises a portable heating and cooling container. The portable heating and cooling container is configured to keep retained liquids heated or cooled in the same compartment. The retained liquids could be water, beverages, or any other liquid desired to keep warmed or cooled.

The portable heating and cooling container comprises an insulated vessel and a heating component. The insulated vessel comprises a vessel housing and a lid and is typically sized to retain between one and ten gallons of a liquid within the vessel housing. The vessel housing comprises an outer wall, an inner wall, and an insulating layer sandwiched between the inner and outer walls. The inner and outer walls form a cylindrical sidewall that terminates in a floor so that the vessel housing is open at the top.

The lid is configured to engage the open top of the vessel housing, so that when attached, the insulated vessel completely encapsulates any contents. The lid is generally circular and sized to fit the open top of the vessel housing. The lid may comprise an insulating layer sandwiched between an inner and outer wall similar in construction to the vessel housing or may be a constructed as a single layer.

The insulated vessel may further comprise an outlet for dispensing a liquid retained within the insulated vessel without otherwise opening the lid. An inlet configured to connect to a water source may penetrate the vessel housing to add liquid to the insulated vessel without otherwise opening the lid. A heating element opening penetrates the vessel housing laterally and is sealed with a sealing element. A heating component attachment component is configured to attach the heating component to the vessel housing.

The heating component comprises a heating component housing and a heating element. The heating component housing is attachable to an exterior of the vessel housing via the heating component attachment component. The heating element extends laterally out of the heating component housing, through the heating element opening in the vessel housing, and into an interior of the insulated vessel. The heating element is configured to heat the retained liquid within the insulated vessel via resistance heating.

The heating component may further comprises a controller. The controller is integrated into the heating component housing. The heating component may further comprises a thermostat. The thermostat is integrated into the heating component housing and is programmable via the controller. The heating component may further comprises a timer. The timer is integrated into the heating component housing and is programmable via the controller. The heating component may further comprises a temperature gauge. The temperature gauge is integrated into the heating component housing. The heating component may be powered by an external alternating current power source.

In an additional embodiment, the portable heating and cooling container comprises an insulated vessel and a heating component. The insulated vessel comprises a vessel housing and a lid and is typically sized to retain between one and ten gallons of a liquid within the vessel housing. The vessel housing comprises an outer wall, an inner wall, and an insulating layer sandwiched between the inner and outer walls. The inner and outer walls form a cylindrical sidewall and terminate in a floor so that the vessel housing is open at the top.

The lid is configured to engage the open top of the vessel housing, so that when attached, the insulated vessel completely encapsulates any contents. The lid is generally circular and sized to fit the open top of the vessel housing. A heating element opening penetrates the lid vertically and is sealed with a sealing element. The lid may comprise an insulating layer sandwiched between an inner and outer wall similar in construction to the vessel housing or may be a constructed as a single layer. A heating component attachment component is configured to attach the heating component to the lid.

The insulated vessel may further comprise an outlet for dispensing a liquid retained within the insulated vessel without otherwise opening the lid. An inlet configured to connect to a water source may penetrate the vessel housing to add liquid to the insulated vessel without otherwise opening the lid.

The heating component comprises a heating component housing and a heating element. The heating component housing is attachable to an exterior of the lid via the heating component attachment component. The heating element extends downward out of the heating component housing, through the heating element opening in the lid, and into an interior of the insulated vessel. The heating element is a liquid heating element configured to heat the retained liquid within the insulated vessel via resistance heating.

The heating component may further comprises a controller. The controller is integrated into the heating component housing. The heating component may further comprises a thermostat. The thermostat is integrated into the heating component housing and is programmable via the controller. The heating component may further comprises a timer. The timer is integrated into the heating component housing and is programmable via the controller. The heating component may further comprises a temperature gauge. The temperature gauge is integrated into the heating component housing. The heating component may be powered by an external alternating current power source.

To the accomplishment of the foregoing and related ends, certain illustrative aspects of the disclosed innovation are described herein in connection with the following description and the annexed drawings. These aspects are indicative, however, of but a few of the various ways in which the principles disclosed herein can be employed and is intended to include all such aspects and their equivalents. Other advantages and novel features will become apparent from the following detailed description when considered in conjunction with the drawings.

BRIEF DESCRIPTION OF THE DRAWINGS

The description refers to provided drawings in which similar reference characters refer to similar parts throughout the different views, and in which.

DETAILED DESCRIPTION

Figure 1:
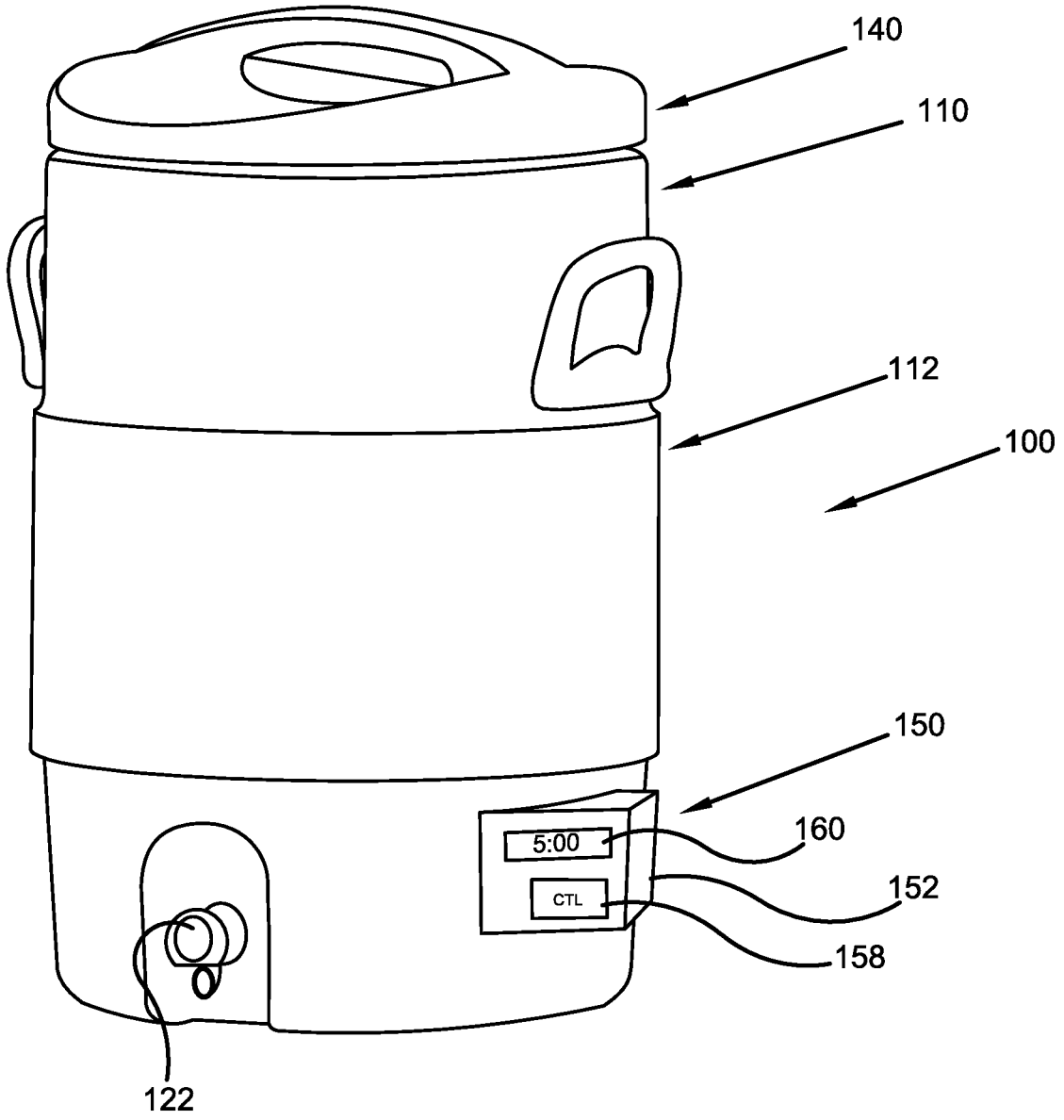
FIG. 1 illustrates a perspective view of a portable heating and cooling container of the present invention for keeping retained contents heated or cooled in accordance with the disclosed architecture.

The innovation is now described with reference to the drawings, wherein like reference numerals are used to refer to like elements throughout. In the following description, for purposes of explanation, numerous specific details are set forth in order to provide a thorough understanding thereof. It may be evident, however, that the innovation can be practiced without these specific details. In other instances, well-known structures and devices are shown in block diagram form in order to facilitate a description thereof. Various embodiments are discussed hereinafter. It should be noted that the figures are described only to facilitate the description of the embodiments. They do not intend as an exhaustive description of the invention or do not limit the scope of the invention. Additionally, an illustrated embodiment need not have all the aspects or advantages shown. Thus, in other embodiments, any of the features described herein from different embodiments may be combined.

The present invention, in one exemplary embodiment, is a portable insulated heating and cooling water jug that can have handles on both sides. It has a sealed and removable top to help contain water or other liquids from leaking out. There is an electric heating element installed on the inside of the container to heat water for purposeful use. The outside of the container may have a power source connected with a long cord that plugs into a receptacle. The cooler can hold warm/hot or cool/cold water. The water inside can be heated using the heating element when the cooler is plugged into a power source. The retained water will then stay warm for an extended period of time.

Referring initially to the drawings, FIGS. 1-8 illustrate a portable heating and cooling container 100. The portable heating and cooling container 100 is configured to keep retained liquids heated or cooled in the same compartment. The retained liquids could be water, beverages, or any other liquid desired to keep warmed or cooled. The portable heating and cooling container 100 provides access to cooled or warmed water or other liquids at any location where there is typically no refrigeration or heat source.

Figure 2:
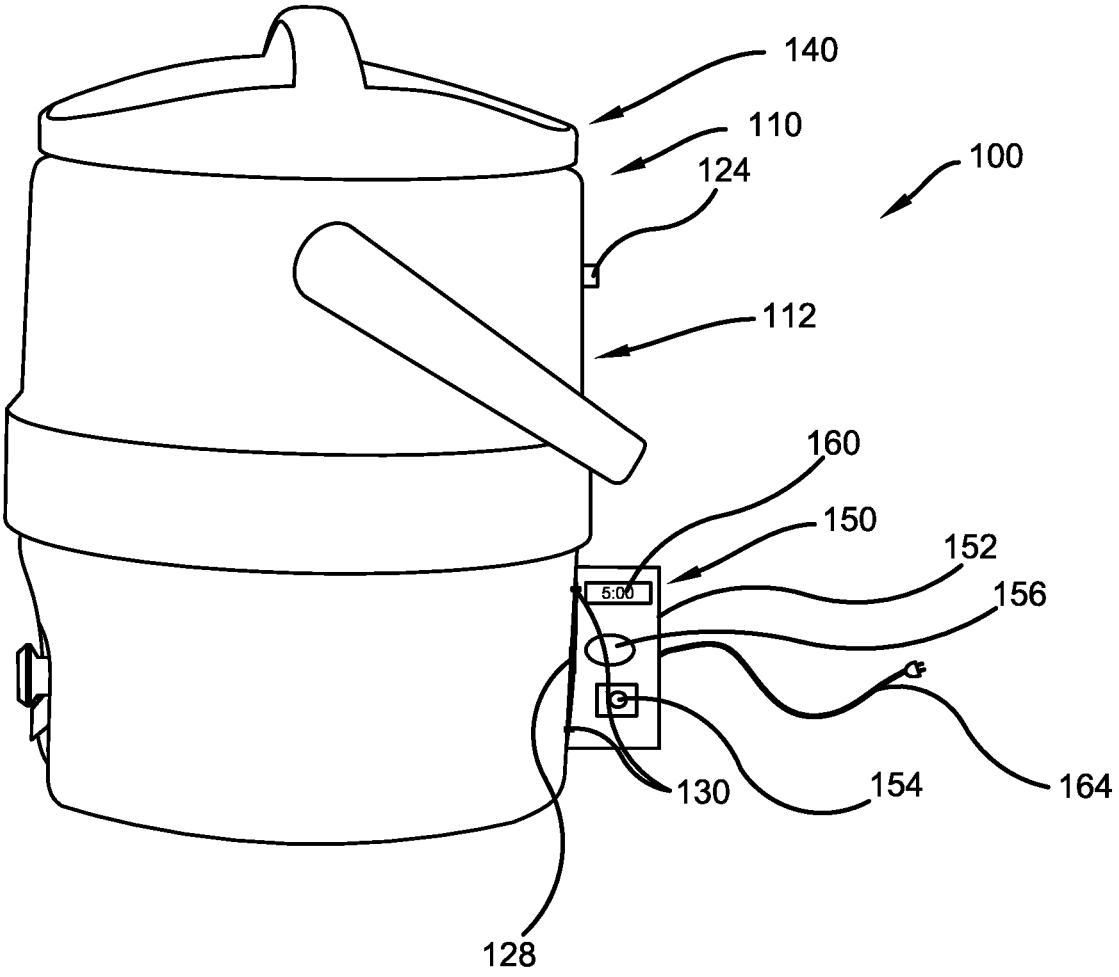
FIG. 2 illustrates a perspective side view of the portable heating and cooling container of the present invention for keeping retained contents heated or cooled in accordance with the disclosed architecture.
Figure 3:
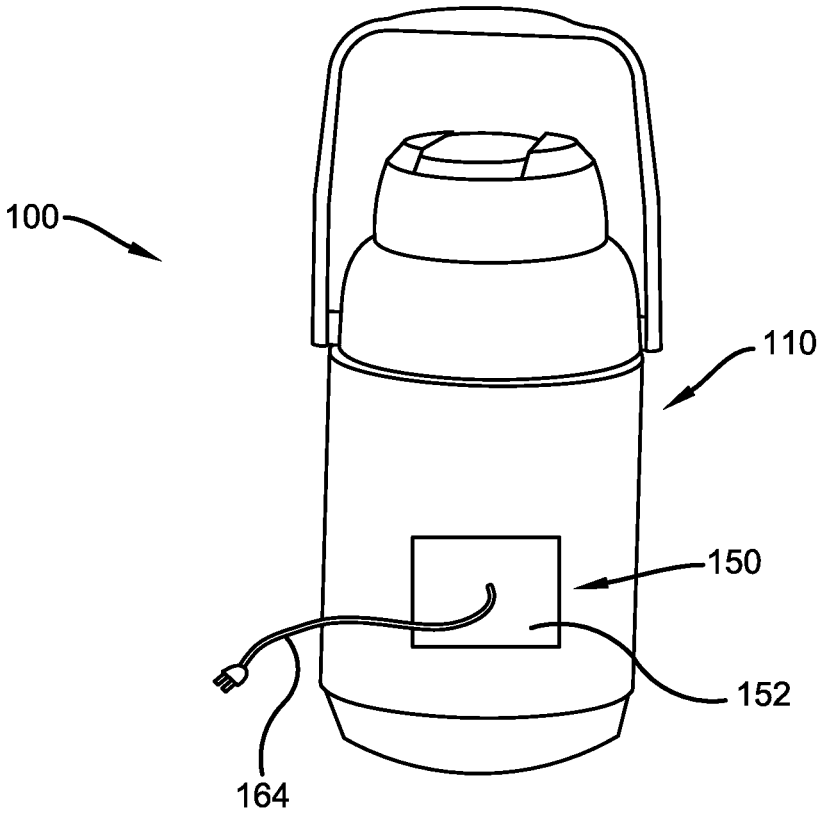
FIG. 3 illustrates a perspective rear view of the portable heating and cooling container of the present invention for keeping retained contents heated or cooled in accordance with the disclosed architecture.

As illustrated in FIGS. 1-3, the portable heating and cooling container 100 comprises an insulated vessel 110 and a heating component 150. The insulated vessel 110 comprises a vessel housing 112 and a lid 140. While the insulated vessel 110 is typically sized to retain between one and ten gallons of a liquid within the vessel housing 112, although this is not meant as a limitation as it may be larger or smaller as desired. In one embodiment, the insulated vessel 110 may be a five gallon insulated liquid water cooler or jug.

Figure 4:
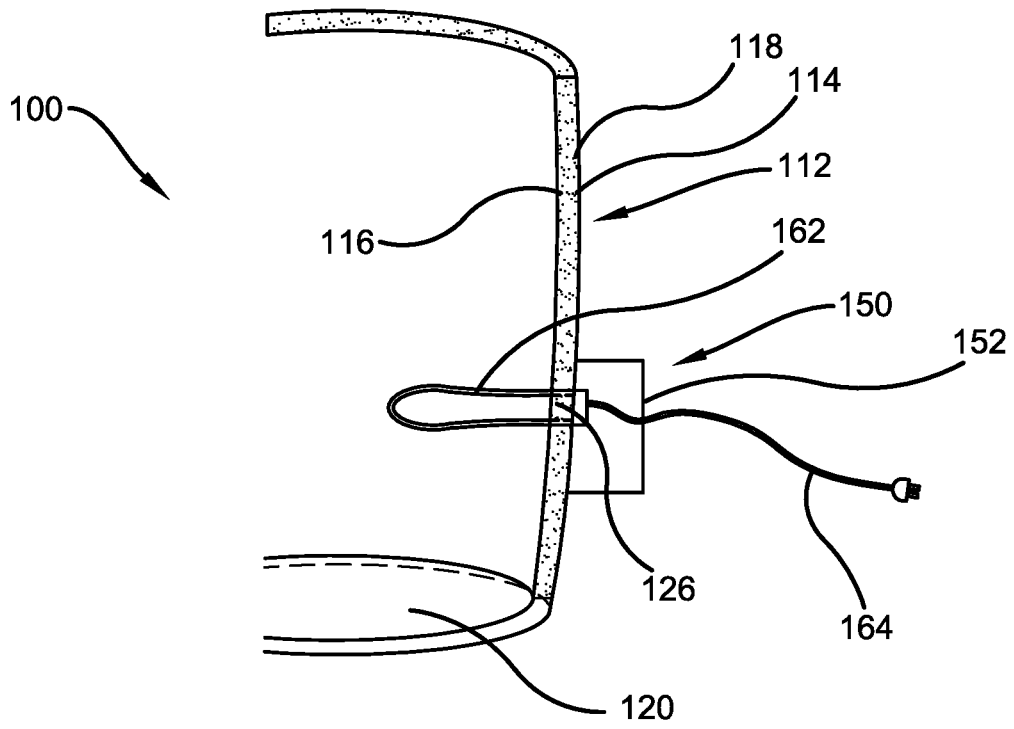
FIG. 4 illustrates a partial cross sectional view of the portable heating and cooling container of the present invention for keeping retained contents heated or cooled in accordance with the disclosed architecture.
Figure 5:
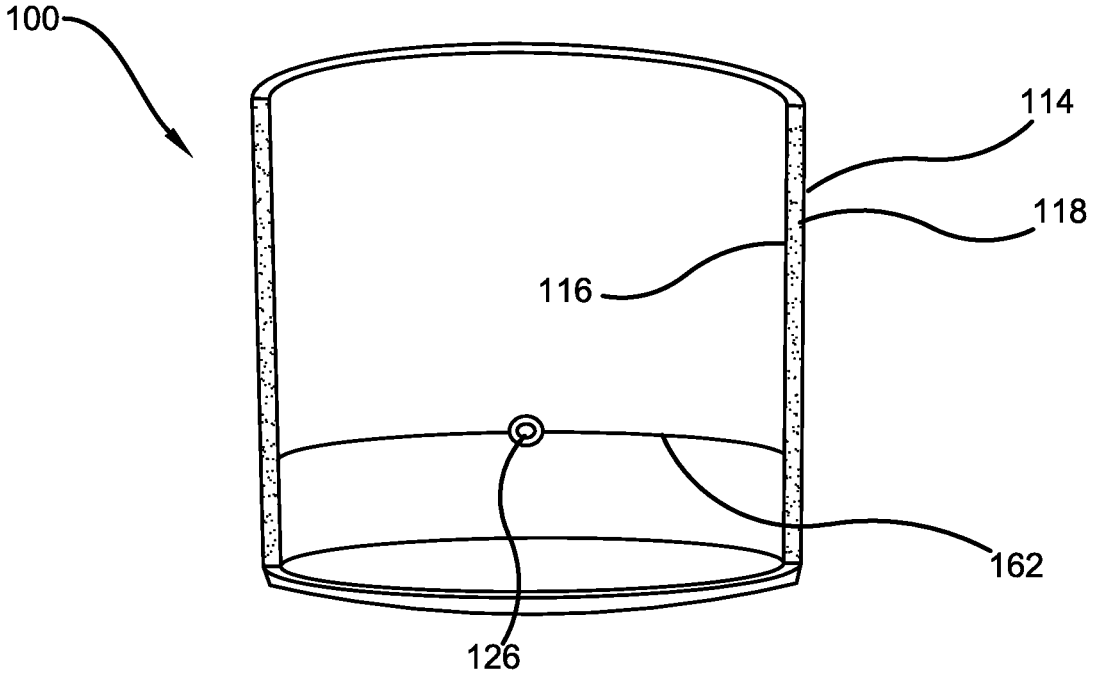
FIG. 5 illustrates a cross sectional view of the portable heating and cooling container of the present invention for keeping retained contents heated or cooled in accordance with the disclosed architecture.
Figure 6:
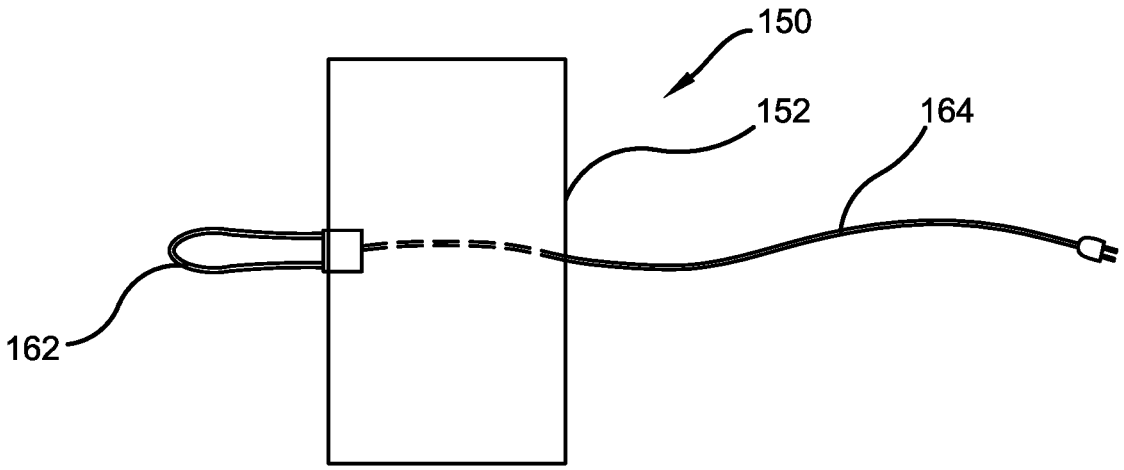
FIG. 6 illustrates a side view of a heating component of the portable heating and cooling container of the present invention for keeping retained contents heated or cooled in accordance with the disclosed architecture.
Figure 7:
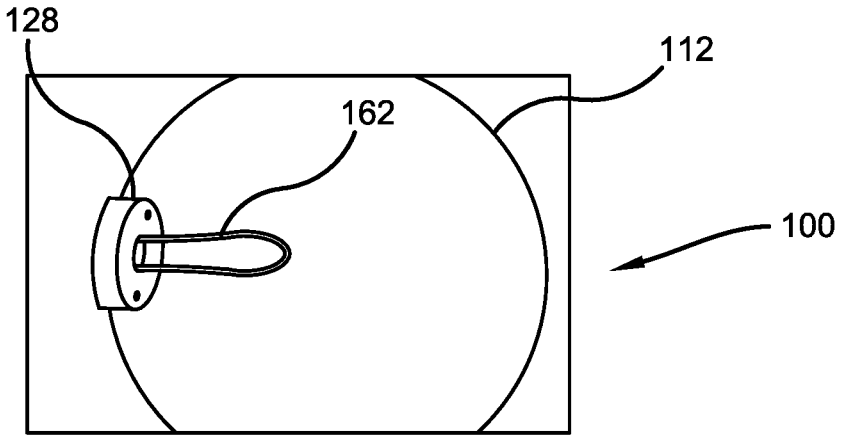
FIG. 7 illustrates an overhead view of the portable heating and cooling container of the present invention for keeping retained contents heated or cooled in accordance with the disclosed architecture.
Figure 8:
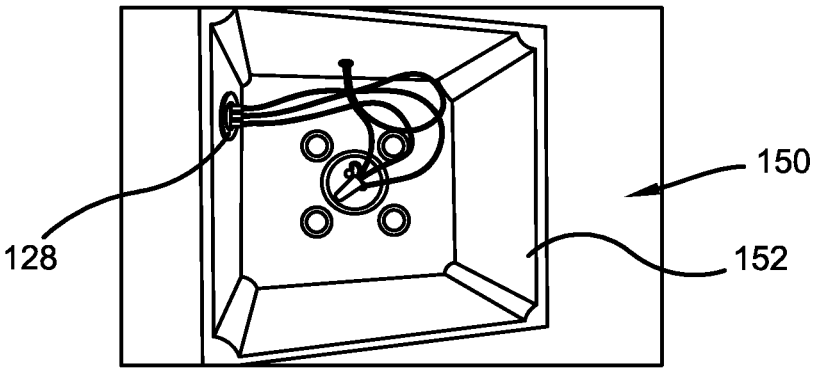
FIG. 8 illustrates a perspective view of the portable heating component of the heating and cooling container of the present invention for keeping retained contents heated or cooled in accordance with the disclosed architecture.

As illustrated in FIGS. 4 and 5, the vessel housing 112 comprises an outer wall 114, an inner wall 116, and an insulating layer 118. The insulating layer 118 is sandwiched between the inner and outer walls 116 and 114. The insulating layer 118 may be a layer of rigid foam insulation, liquid insulation, or may be a vacuum layer. The inner and outer walls 116 and 114 generally form a cylindrical sidewall that terminates in a floor 120 so that the vessel housing 112 is open at the top. Alternatively, the inner and outer walls 116 and 114 may form any shape as desired.

The lid 140 is configured to engage the open top of the vessel housing 112. When the lid 140 is attached, the insulated vessel 110 completely encapsulates any retained liquid contents. The lid 140 is generally circular and sized to fit the open top of the vessel housing 112. The lid 140 may comprise an insulating layer sandwiched between an inner and outer wall similar in construction to the vessel housing 112 or may be a constructed as a single layer. The lid 140 may be threaded and screw on, push on and held in place via friction, or may be hingedly attached and mechanically locked in place.

The insulated vessel 110 may further comprise an outlet 122. The outlet 122 is typically a one-way valve or spout for dispensing the liquid retained within the insulated vessel 110 without otherwise opening the lid 140. As illustrated in FIG. 2, an inlet 124 configured to connect to a water source, such as a hose, may penetrate the vessel housing 112 to add liquid to the insulated vessel 110 without otherwise opening the lid 140. As illustrated in FIGS. 2 and 5, a heating element opening 126 penetrates the vessel housing 112 laterally. The heating element opening 126 is sealed with a sealing element 128, such as a sealing gasket or one-way valve to prevent liquid from escaping the insulated vessel 110. A heating component attachment component 130 is configured to attach the heating component 150 to the vessel housing 112. The heating component attachment component 130 may be mechanical fasteners, a bracket, an adhesive, or the like to permanently or detachably attach the heating component 150 to the vessel housing 112.

As illustrated in FIGS. 2 and 4-8, the heating component 150 comprises a heating component housing 152 and a heating element 162. The heating component housing 150 is a water resistant metal or plastic housing attachable to an exterior of the vessel housing 112 via the heating component attachment component 140 as illustrated in FIG. 2 and described supra. The heating element 162 extends laterally out of a back of the heating component housing 152, through the heating element opening 126 in the vessel housing 112, and into an interior of the insulated vessel 110.

The heating element 162 is configured to heat the retained liquid within the insulated vessel 110 via resistance heating. The heating element 162 is typically a resistance heating element, such as an immersion liquid heater and may be encapsulated in a protective outer cover. The heating element 162 may be tubular, coiled, straight, or looped around an interior perimeter of the vessel housing 112. The heating element 162 may be constructed from nichrome, nickel and stainless steel, ceramics, polymers, a flexible silicon or rubber, or may be a cartridge heating element. Additionally, the watt density of the heating element 162 is generally dependent on the size of the insulated vessel 110. In a smaller embodiment the watt density is at least 25 watts per square inch; and in a larger embodiment, the watt density is at least 70 watts per square inch. The heating element 162 could also be protected with a grill guard (not shown) for additional protection.

The heating component 150 may further comprises a controller 158. The controller 158 is typically a control panel, dial, switch, LCD screen, or similar controller component that is integrated into an exterior of the heating component housing 152. The heating component 150 may further comprises a thermostat 154. The thermostat 154 is integrated into the heating component housing 152 and is programmable via the controller 158. The heating component 150 may further comprises a timer 160. The timer 160 is integrated into the heating component housing 152 and is programmable via the controller 158 or independently controllable to prevent overheating. The heating component 150 may further comprises a temperature gauge 156. The temperature gauge 156 is integrated into the heating component housing 152. The heating component 150 is powered by a power source 164. The power source 164 may be a plug connectable to an external alternating current power source, such as a wall outlet or a generator. Alternatively, the power source 164 may be a battery (not shown) housed within the heating component housing 152, a solar power cell (not shown) attachable to an exterior of the lid 140, or any combination thereof.

In an additional embodiment as illustrated in FIGS. 1-10, the portable heating and cooling container 100 comprises an insulated vessel 110 and a heating component 150. The insulated vessel comprises a vessel housing 112 and a lid 140. The vessel housing 112 comprises an outer wall 114, an inner wall 116, and an insulating layer 118. The insulating layer 118 is sandwiched between the inner and outer walls 116 and 114. The insulating layer 118 may be a layer of rigid foam insulation, liquid insulation, or may be a vacuum layer. The inner and outer walls 116 and 114 generally form a cylindrical sidewall that terminates in a floor 120 so that the vessel housing 112 is open at the top. Alternatively, the inner and outer walls 116 and 114 may form any shape as desired.

Figure 9:
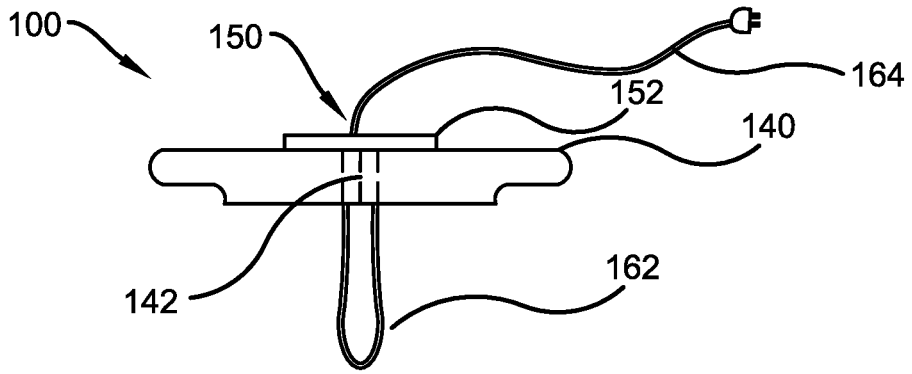
FIG. 9 illustrates a side cross sectional view of the portable heating and cooling container of the present invention for keeping retained contents heated or cooled in accordance with the disclosed architecture.
Figure 10:
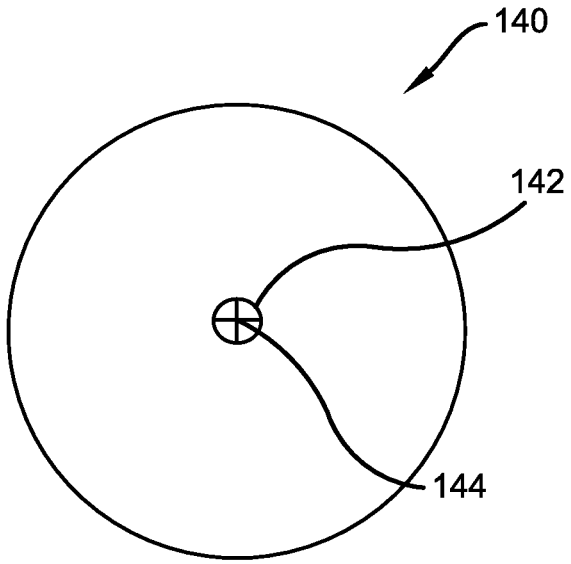
FIG. 10 illustrate an overhead view of a lid of an insulated vessel of the portable heating and cooling container of the present invention for keeping retained contents heated or cooled in accordance with the disclosed architecture.

As illustrated in FIGS. 9 and 10, the lid 140 is configured to engage the open top of the vessel housing 112, so that when attached, the insulated vessel 110 completely encapsulates any contents. The lid 140 is generally circular and sized to fit the open top of the vessel housing 112. A heating element opening 142 penetrates the lid 140 vertically and is sealed with a sealing element 144, such as a gasket or one-way valve. The lid 140 may comprise an insulating layer sandwiched between an inner and outer wall similar in construction to the vessel housing or may be a constructed as a single layer. The lid 140 may also be vented with a relief valve (not shown). A heating component attachment component 130 is configured to attach the heating component 150 to the lid 140. The heating component attachment component 130 may be mechanical fasteners, a bracket, an adhesive, or the like to permanently or detachably attach the heating component 150 to the lid 140. The lid 140 may be threaded and screw on, push on and held in place via friction, or may be hingedly attached and mechanically locked in place. The lid 140 may also employ a lock-in/out system for safety.

The insulated vessel 110 may further comprise an outlet 122. The outlet 122 is typically a one-way valve or spout for dispensing the liquid retained within the insulated vessel 110 without otherwise opening the lid 140. As illustrated in FIG. 2, an inlet 124 configured to connect to a water source, such as a hose, may penetrate the vessel housing 112 to add liquid to the insulated vessel 110 without otherwise opening the lid 140.

The heating component heating component 150 comprises a heating component housing 152 and a heating element 162. The heating component housing 150 is a water resistant metal or plastic housing attachable to an exterior of the lid 140 via the heating component attachment component 140. The heating element 162 extends downward out of the heating component housing 152, through the heating element opening 126 in the lid 140, and into an interior of the insulated vessel 110.

The heating element 162 is configured to heat the retained liquid within the insulated vessel 110 via resistance heating. The heating element 162 is typically a resistance heating element, such as an immersion liquid heater and may be encapsulated in a protective outer cover. The heating element 162 may be tubular, coiled, straight, or looped around an interior perimeter of the vessel housing 112. The heating element 162 may be constructed from nichrome, nickel and stainless steel, ceramics, polymers, a flexible silicon or rubber, or may be a cartridge heating element.

The heating component 150 may further comprises a controller 158. The controller 158 is typically a control panel, dial, switch, LCD screen, or similar controller component that is integrated into an exterior of the heating component housing 152. The heating component 150 may further comprises a thermostat 154. The thermostat 154 is integrated into the heating component housing 152 and is programmable via the controller 158. The heating component 150 may further comprises a timer 160. The timer 160 is integrated into the heating component housing 152 and is programmable via the controller 158 or independently controllable. The heating component 150 may further comprises a temperature gauge 156. The temperature gauge 156 is integrated into the heating component housing 152. The heating component 150 is powered by a power source 164. The power source 164 may be a plug connectable to an external alternating current power source, such as a wall outlet or a generator. Alternatively, the power source 164 may be a battery (not shown) housed within the heating component housing 152, or a solar power cell (not shown) attachable to an exterior of the lid 140.

Notwithstanding the forgoing, the heating and cooling container 100 can be any suitable size, shape, and configuration as is known in the art without affecting the overall concept of the invention, provided that it accomplishes the above stated objectives. One of ordinary skill in the art will appreciate that the shape and size of the heating and cooling container 100 and its various components, as show in the FIGS. are for illustrative purposes only, and that many other shapes and sizes of the heating and cooling container 100 are well within the scope of the present disclosure. Although dimensions of the heating and cooling container 100 and its components (i.e., length, width, and height) are important design parameters for good performance, the heating and cooling container 100 and its various components may be any shape or size that ensures optimal performance during use and/or that suits user need and/or preference. As such, the heating and cooling container 100 may be comprised of sizing/shaping that is appropriate and specific in regard to whatever the heating and cooling container 100 is designed to be applied.

What has been described above includes examples of the claimed subject matter. It is, of course, not possible to describe every conceivable combination of components or methodologies for purposes of describing the claimed subject matter, but one of ordinary skill in the art may recognize that many further combinations and permutations of the claimed subject matter are possible. Accordingly, the claimed subject matter is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A portable heating and cooling container comprising:

an insulated vessel comprising a vessel housing and an insulated lid; and a heating component comprising a heating component housing attachable to an exterior of the vessel housing and a heating element extending laterally out of the heating component housing, through the vessel housing, and into an interior of the insulated vessel;

a one-way outlet valve penetrating the vessel housing;

a liquid fill inlet penetrating the vessel housing; and wherein the vessel housing comprises an inner wall and an outer wall encapsulating an insulating vacuum layer within;

wherein the heating element penetrates the vessel housing through an opening in the vessel housing and is sealed within the opening via a one-way sealing valve; and wherein the heating element is a ceramic heating element.

2. The portable heating and cooling container of claim 1, wherein the vessel housing is sized to retain between one and ten gallons of a liquid.

3. The portable heating and cooling container of claim 1, wherein the insulated vessel is a five gallon insulated liquid cooler.

4. The portable heating and cooling container of claim 1, wherein the heating element is an immersion liquid heater.

5. The portable heating and cooling container of claim 1, wherein the heating element is a resistance heater.

6. The portable heating and cooling container of claim 1, wherein the heating element is encapsulated.

7. The portable heating and cooling container of claim 1, wherein a watt density of the heating element is at least 70 watts per square inch.

8. The portable heating and cooling container of claim 1, wherein the heating element is tubular.

9. The portable heating and cooling container of claim 1, wherein the heating element is looped around an interior perimeter of the vessel housing.

10. The portable heating and cooling container of claim 1, wherein the heating element is flexible.

11. The portable heating and cooling container of claim 1, wherein the heating component further comprises a thermostat integrated into the heating component housing.

12. The portable heating and cooling container of claim 1, wherein the heating component further comprises a temperature gauge integrated into the heating component housing.

13. The portable heating and cooling container of claim 1, wherein the heating component further comprises a timer integrated into the heating component housing.

14. The portable heating and cooling container of claim 1, wherein the heating component is powered by alternating current.

15. The portable heating and cooling container of claim 1, wherein the heating component is battery powered.

16. A portable heating and cooling container comprising:

an insulated vessel comprising a vessel housing and an insulated lid; and a heating component comprising:

a heating component housing attachable to an exterior of the vessel housing;

a heating element extending laterally out of the heating component housing, through the vessel housing, and into an interior of the insulated vessel;

a one-way outlet valve penetrating the vessel housing;

a liquid fill inlet penetrating the vessel housing;

a thermostat integrated into the heating component housing;

a temperature gauge integrated into the heating component housing; and a controller integrated into the heating component housing for programming the thermostat; and wherein the vessel housing comprises an inner wall and an outer wall encapsulating an insulating vacuum layer within; and wherein the heating element penetrates the vessel housing through an opening in the vessel housing and is sealed within the opening via a one-way sealing valve; and wherein the heating element is a cartridge body heating element.

17. The portable heating and cooling container of claim 16, wherein the heating component further comprises a timer integrated into the heating component housing programmable via the controller.

* * * * *